United States Patent [19]

Williford et al.

[11] Patent Number: 4,819,730

[45] Date of Patent: Apr. 11, 1989

[54] DEVELOPMENT DRILLING SYSTEM

[75] Inventors: Frank B. Williford, Frisco; James M. Luke, Keller; Paul V. Devlin, Rowlett, all of Tex.

[73] Assignee: Schlumberger Technology Corporation, Houston, Tex.

[21] Appl. No.: 77,365

[22] Filed: Jul. 24, 1987

[51] Int. Cl.[4] ..... E21B 7/128; E02D 21/00; B63H 25/00

[52] U.S. Cl. ..... 166/355; 166/341; 166/359; 166/360; 166/366; 114/144 B; 175/7; 405/195

[58] Field of Search ..... 166/359, 360, 352–355, 166/366, 341, 367, 345, 346, 358; 175/7, 8; 405/195; 114/144 B, 264, 265; 364/432, 449

[56] References Cited

U.S. PATENT DOCUMENTS

| | | | |
|---|---|---|---|
| 2,973,046 | 2/1961 | McLean et al. | 175/8 |
| 3,313,345 | 4/1967 | Fischer . | |
| 3,434,550 | 3/1969 | Townsend | 175/5 |
| 3,601,187 | 8/1971 | Tidwell . | |
| 3,817,325 | 6/1974 | Mott et al. | 175/7 |
| 3,983,706 | 10/1976 | Kalinowski | 61/98 |
| 3,993,273 | 11/1976 | Dade | 405/195 |
| 3,999,617 | 12/1976 | Ilfrey et al. | 175/7 |
| 4,031,544 | 6/1977 | Lapetina | 358/99 |
| 4,142,584 | 3/1979 | Brewer et al. | 166/359 |
| 4,170,266 | 10/1979 | Fayren | 175/7 |
| 4,188,156 | 2/1980 | Fisher et al. | 405/195 |
| 4,198,179 | 4/1980 | Pease et al. | 405/195 |
| 4,214,842 | 7/1980 | Franks | 166/341 |
| 4,301,760 | 11/1981 | Cassone et al. | 114/144 B |
| 4,351,027 | 9/1982 | Gay et al. | 114/144 B |
| 4,351,261 | 9/1982 | Shanks | 114/264 |
| 4,556,340 | 12/1985 | Morton | 405/195 |
| 4,576,516 | 3/1986 | Denison | 405/195 |
| 4,666,340 | 5/1987 | Cox | 405/195 |

FOREIGN PATENT DOCUMENTS

| | | | |
|---|---|---|---|
| 2182083 | 5/1987 | United Kingdom | 166/366 |

OTHER PUBLICATIONS

R. D. Young, "Methods of Analysis for Marine Riser Design and Operations," Petroleum Mechanical Engineering Workshop and Conference, Sep. 13–15, 1981.

B. G. Burke, "An Analysis of Marine Risers for Deep Water," OTC 1771, May 1973.

L. P. Krolikowski & T. A. Gay, "An Improved Linearization Technique for Frequency Domain Riser Analysis," OTC 3777, May 5–8, 1980.

R. D. Foreman, P. A. Beynet, S. N. Singhal, and L. H. Seidl, "On-Board System Provides Stability, Mooring, and Motion Analysis for Semisubmersible Drilling Operations," SPE/IADC 16067, Mar. 15–18, 1987.

W. C. Lamb, Jr., H. C. Hibbard, A. L. James, W. A. Koerner, and R. H. Rothberg, "Instrumentation for Monitoring Behavior of Lena Guyed Tower," OTC 4684, May 7–9, 1984.

"API Recommended Practice for the Analysis of Spread Mooring Systems for Floating Drilling Units," American Petroleum Institute, Jan. 1, 1984.

*Primary Examiner*—Bruce M. Kisliuk

*Attorney, Agent, or Firm*—Stephen L. Borst

[57] ABSTRACT

A floating drilling platform having dual work stations is disclosed for performing deep sea drilling and/or hydrocarbon production operations. The structure of the platform is designed to accommodate replaceable modules which facilitate the installation and removal of either a drilling derrick or production equipment. Thus, during the drilling phase of a reservoir's development, the platform may be outfitted with dual drilling derricks while at later times the platform may be outfitted with a drilling derrick and a full production facility. Various expedients are available to permit the equipment of one work station to be used in conjunction with the equipment of one other. Simultaneous management of dual conductors is enabled by a dual riser management system which models in real time riser behavior under varying environmental and other operational conditions. The dual riser management system includes a riser analysis subsystem, a mooring analysis subsystem and a vessel stability analysis subsystem.

20 Claims, 7 Drawing Sheets

DEVELOPMENT DRILLING SYSTEM

BACKGROUND OF THE INVENTION

1. Field of the Invention

The present invention relates generally to deep sea drilling equipment and in particular to the construction and operation of a deep sea offshore drilling and development platform having dual work stations for simultaneously conducting oilfield operations from each of the work stations. More particularly, the present invention relates to systems and apparatae required to permit drilling and/or production operations simultaneously from two adjacent positions on a floating platform while preventing operations being conducted by one of the work stations from interfering with the operations being conducted by the other work station. Most notably, the invention includes means for determining the relative position between two marine risers depending from two respective work stations based on environmental and other parameters. Such means also provides the capability to calculate the effect of changes in system parameters induced specifically to control the relative position of the two conductor pipes (marine risers).

2. Description of the Prior Art

Search for offshore deposits of crude oil and natural gas is continually being extended into deeper and deeper waters beyond the continental shelf. Where possible, one of the preferred techniques for performing the operations necessary for the production of hydrocarbons from offshore reservoirs is to erect a structure or drilling platform which is in some fashion rigidly secured to the sea floor. Such a technique may comprise any of a variety of structures including jackup rigs, tension leg platforms, free standing or guyed towers. A notable advantage of such structures is their rigid nature which significantly simplifies subsea operations during conditions which exert lateral or vertical forces on the structure. The rigid character of such structures limits their movement to less than four degrees of freedom (0 for a rigid tower and up to 3 for a tension leg platform). It has, therefore, been found possible to operate a pair of drilling derricks on such rigid, bottom founded structures. With such rigid structures operation of two conductor pipes simultaneously has not caused significant problems to arise due to the active guidance available with these systems. U.S. Pat. Nos. 2,973,046 and 4,170,266 are illustrative platforms which are supported in a rigid or semi rigid fashion from the sea floor. There is, however, a limit to the water depths in which rigid, bottom founded drilling platforms can be effectively, safely and economically operated Where the sea depth exceeds this limit, floating platforms such as drilling ships or semi-submersible platforms have found application. According to conventional procedures, a floating drilling vessel is dynamically moored above a well site on the ocean floor. Dynamic mooring, as opposed to rigid, bottom founded support permits the floating platform to dynamically move with up to six degrees of freedom, under prevailing forces such as wave action, tidal action, sea currents and wind conditions. This dynamic mooring somewhat complicates the equipment and procedures employed in drilling a well in the sea floor. In this process, a wellhead is first manipulated into position and installed on the sea floor. Then a blowout preventer (BOP) stack is lowered from the floating rig and mounted on top of the casing of the wellhead as a means for controlling the pressures which may arise at the surface opening of the well. The installation of such equipment is conventionally performed by lowering the equipment from the rig on the end of marine risers. A drill string is next extended from the floating vessel to the bottom of the well through the wellhead equipment on the ocean floor. The drill string is enclosed within the riser pipe which has been attached to the wellhead equipment and which is supported under tension from the floating drilling vessel to prevent its collapse. Drilling mud is circulated through the drill string and is returned through the riser annulus which surrounds the drill pipe. As can be easily imagined, the marine risers required for drilling and production operations in very deep water become quite heavy and unwieldily. Unfortunately, the movement of a floating drilling vessel under the influence of weather, tide and current conditions greatly increases the difficulty of managing the riser as contrasted to the situation of a rigid, bottom founded platforms since movement of the vessel excites dynamic motions in the riser systems.

Drilling vessels and other apparatus employed in the drilling of oil wells offshore are generally large and very expensive and their daily operation involves rates exceeding many thousands of dollars a day, a cost which constitutes a major portion of the overall well cost. Thus, it is very important that the drilling operations of such a vessel be performed with as little interruption as possible. In the past, standard practice has been to sequentially prepare a plurality of wells from a floating vessel with a single drilling platform. Once drilling is complete and the wells have been placed in condition for operation, the floating drilling vessel is typically removed and replaced by a floating production facility. This is attendant with numerous disadvantages including the increased cost due to the removal and replacement of the floating drilling vessel with a floating production platform, the need for preparing and maintaining redundant vessels (one for drilling and the other for production), and the loss of considerable amounts of time during which the floating drilling vessel is replaced with the floating production facility. Additional time is lost and expense incurred in the not uncommon occasion in which a drilling rig is once again required at the well site. For example, producing wells are known to develop waxy buildups or other conditions which reduce or jeopardize the fluid flow from the formation into the well and which require a workover operation that can be conducted only from a drilling rig. As a result, the production facility may have to be removed and replaced with a floating drilling vessel which contains the drilling rig in order to perform the workover operations.

As previously suggested one approach that has availed itself with bottom, vertically upwardly supported fixed platforms has been the provision of two, side by side drilling rigs on the same platform. Such an arrangement enables a more efficient operation due to the ability to drill approximately twice as many wells in the same amount of time with fewer people and with shared equipment. This approach has not previously been thought suitable for the floating vessel due to the tendency of floating vessels to move about under the prevailing weather, sea current and tidal conditions which, as previously mentioned, tends to produce motion in the marine risers. Clearly, if certain limits of tension, or deflection angle are exceeded, a marine riser can be damaged. Damage may also occur if two risers were to forcibly come into uncontrolled contact with one another or if equipment being lowered by one riser were to collide with the other riser. Drilling risers, while quite stiff over short distances, are quite flexible over the extended distances which they must traverse in the deep water offshore environment. Not only are these risers subjected to sea currents (often of different magnitudes and directions at different depths and times), but they are also subjected to a condition in which the lower end is pinned to the ocean floor at a stationary spot while the upper end must follow the motions of the floating platform.

Numerous attempts have been made in the past to deal with problems which arise in the design and management of marine risers for deep, offshore oil well drilling and production. For example, U.S. Pat. Nos. 3,983,706 and 3,817,325 disclose means for providing lateral support and guidance to marine risers in order to limit their lateral deflection due to currents or platform movement U.S Pat. Nos. 3,601,187; 4,576,516; and 4,188,156 describe flexible joints and flexible riser sections for the purpose of accommodating unavoidable deflection of such risers. U.S. Pat. Nos. 3,313,345 and 4,351,261 disclose apparatus and techniques for preventing the violent collision, of a riser with the floating platform if the riser were to be separated from the wellhead equipment in a planned or emergency disconnect situation. U.S. Pat. Nos. 3,434,550 and 3,999,617 are directed to methods and apparatus for lightening the riser-mud combination to reduce the compressive and tensile forces placed on the riser. And U.S. Pat. Nos. 4,142,584 and 4,198,179 show the conventional approach of ganging multiple risers together as a means of avoiding riser-riser interference.

Many of the problems associated with the operation of a floating drilling vessel having dual work stations, each of which may be outfitted with either a drilling rig or a production facility, are substantially reduced or eliminated by use of the present invention which provides for adequate control of a pair of parallel risers required by the operations conducted on a floating drilling vessel having side by side work stations.

SUMMARY OF THE INVENTION

According to the present invention there is provided an offshore system for conducting operations related to the production of petroleum comprising a floating work platform situated above the ocean surface, first and second work stations on the work platform, first and second oilfield systems conducting production and/or drilling operations positioned at the work stations respectively, first and second longitudinally extending elements extending from the work stations toward the ocean's floor and means for preventing the elements from coming in contact with one another during simultaneous operations conducted from the two work stations on the floating platform.

The floating platform is preferably constructed to include means for removably installing a pair of drilling derricks so that one or both may be easily removed for replacement by production equipment. The dual nature of the work stations permits the equipment at one of the work stations to assist in the operations of the other, such as subsea equipment manipulation. Dual drilling fluid systems are provided with crossover hydraulic connections so that the mud pumps of one of the work stations can provide pumped fluid to the other work station as planned or emergency needs arise.

In the drawings, wherein a preferred embodiment of the present invention is illustrated and wherein like reference numerals are used throughout to designate like parts:

FIG. 3(*b*) is a graphical representation similar to that of FIG. 3(*a*) in which one marine riser is connected to the drilling template by means of a blowout preventer and is distorted by subsea currents while the other marine riser is in the process of lowering a second blowout preventer;

Figure 1:
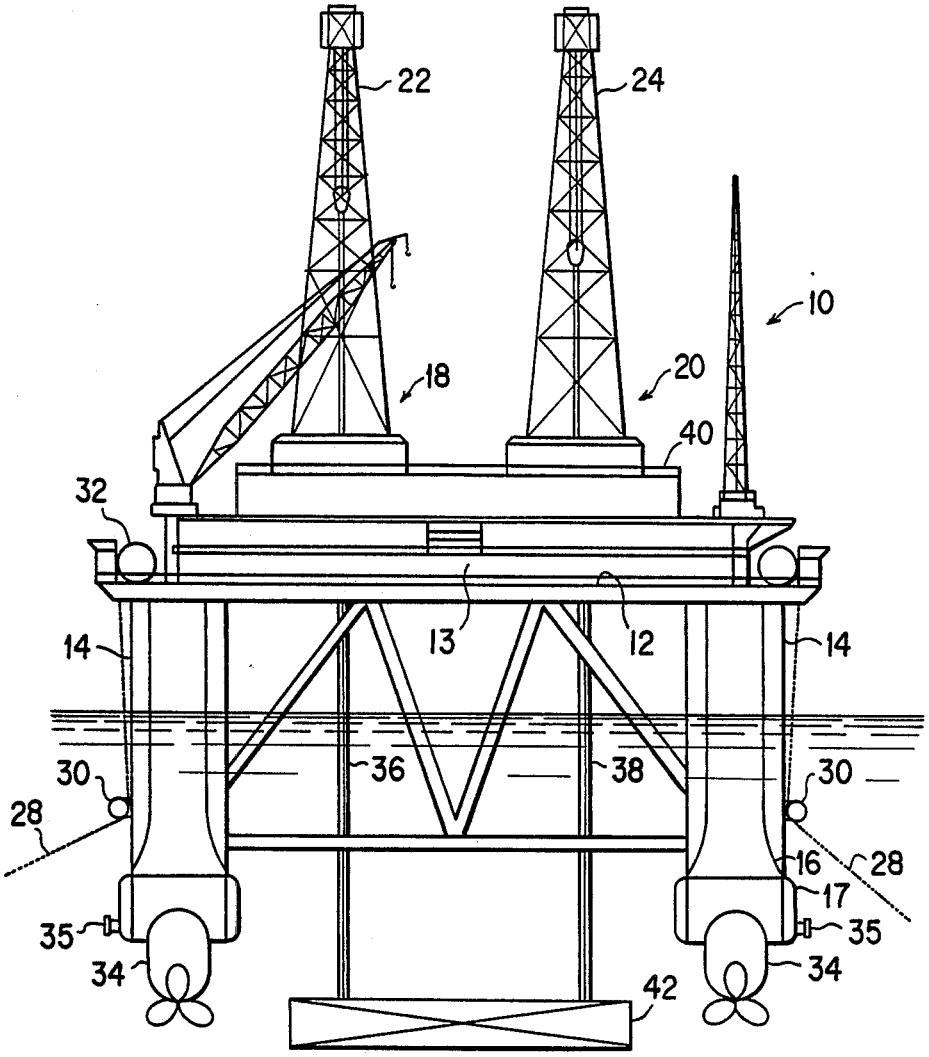
FIG. 1 is a graphical illustration of a semi-submersible floating drilling vessel having dual drilling derricks and dual work platforms whose dual marine risers are cooperatively participating in the manipulation of subsea apparatus.
Figure 2:
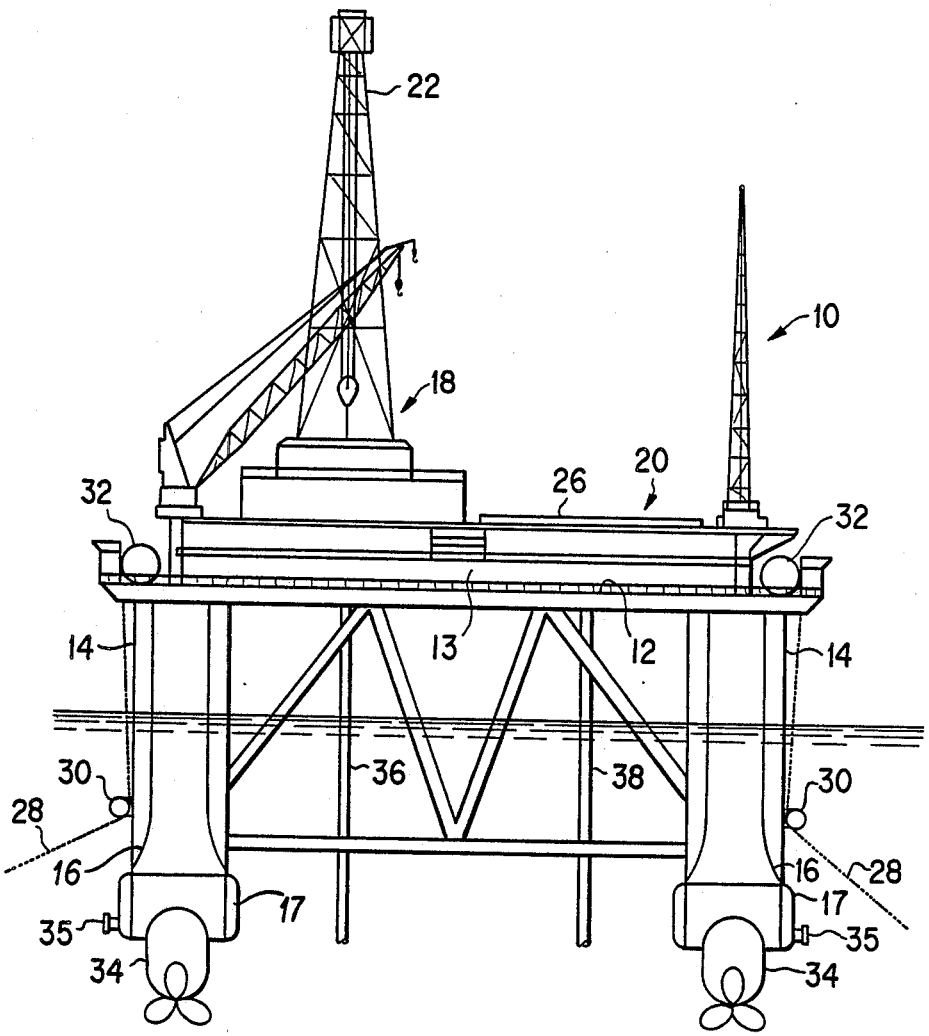
FIG. 2 is a graphical illustration showing a semi-submersible floating drilling and production vessel having a single drilling derrick and a full hydrocarbon fluid handling facility, each having a marine riser dependent therefrom.

Referring to FIGS. 1 and 2, there is shown according to the present invention a floating work platform or vessel 10 which may comprise a drill ship or, preferably a semi-submersible vessel. The illustrated semi-submersible vessel 10 includes a platform or main deck 12 supported by spaced stability columns 14 having footings 16 connected at their lower ends to pontoons 17. Crew living quarters 13 are shown in FIGS. 1 and 2 in front of the hydrocarbon production systems which may include drilling derricks 22, 24 or hydrocarbon fluid handling (production) facilities 26. Unlike conventional semi-submersible floating vessels having one drilling derrick, the illustrated vessel has a pair of first and second work stations 18, 20 at each of which is respectively situated first and second drilling systems or derricks 22 and 24. As will become apparent, the semi-submersible floating vessel 10 may be alternatively configured to have a drilling system derrick 22 at one of its work stations 18 and a hydrocarbon fluid handling or production system 26 situated at the other of its work stations. Where desired, although it is anticipated that this is not a usual configuration, the vessel 10 may include hydrocarbon fluid production equipment at both of its work stations 18, 20. As will also become apparent below, the semi-submersible floating vessel 10 of the present invention is designed and constructed with the intention of facilitating its conversion from a vessel having a pair of drilling derricks 22, 24 to one having a drilling derrick 22 and a complete suite of production equipment 26.

As is conventional with the large semi-submersible vessels 10 of the kind preferred in the practice of this invention, the vessel 10 includes means at appropriate locations (usually but not necessarily limited to its corners) for anchoring or tethering the vessel against the forces of nature such as wind, waves, tides and currents that would tend to move it off of its preferred working position. Such anchoring means might include anchor chain and or cable 28 arranged for catenary anchoring and includes the usual arrangement of sheaves 30 and tensioning winches 32 which can be selectively operated to loosen or tighten the anchoring cable (chain) 28. Judicious and coordinated actuation of these winches 30 may effect vessel positioning maneuvers within the limits permitted by the specific anchoring arrangement adopted. Semi-submersible vessel 10 also may include selectively actuable and rotatable motive means 34, typically referred to as thrusters, for guiding and propelling the semi-submersible in a coordinated manner.

Figure 4:
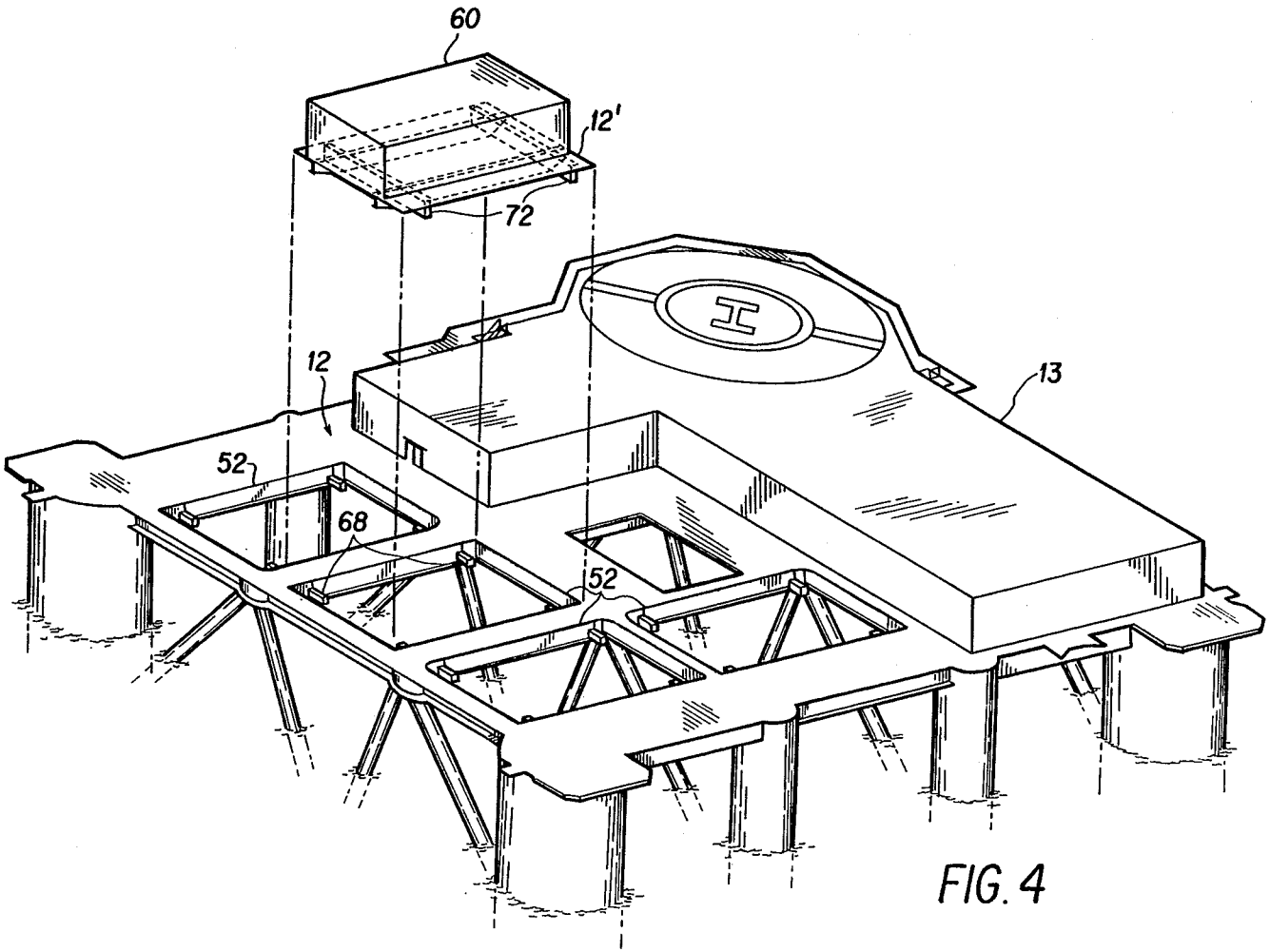
FIG. 4 is an illustration of the deck structure of a semi-submersible floating platform.
Figure 5:
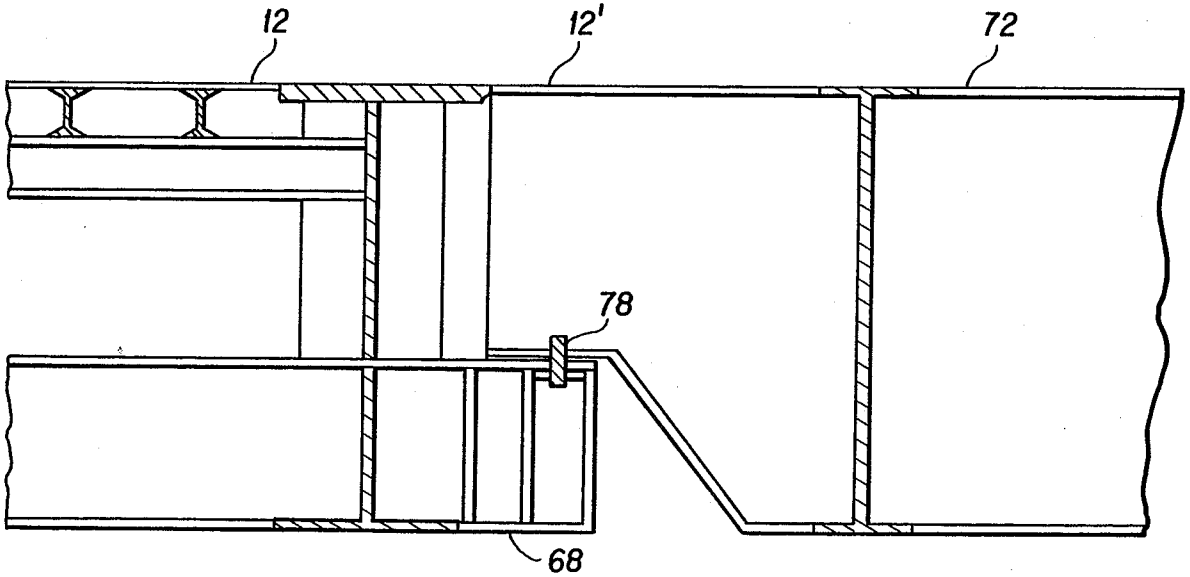
FIG. 5 is an illustration of the portions of a module adapted to be installed on the deck structure illustrated in FIG. 4.

As can be seen in FIGS. 1 and 2, rigs 22 and 24 as well as hydrocarbon fluid handling or production system 26 rest on the main deck 12. Deck 12 is constructed with a regular or modular girder and beam planar construction which has been designed to accommodate either a drilling system 22, 24 or a production system 26. Unlike prior bottom founded platforms, such as that described in U.S. Pat. No. 4,666,340, floating platform 10 and deck 12 are designed such that either a drilling system or a production system may be installed or removed in modular fashion without affecting the structural design of the platform. The design features of deck 12 and associated portions of the under side of a drilling system and a production system are schematically illustrated in FIGS. 4 and 5. FIG. 4 shows deck 12 with a number of open bays 52 awaiting the installation of preassembled modules 60 which comprise either drilling or production equipment. Beams 68 project into the openings of bays 52 and are provided to support mating structural base members 72 of modules 60 as better seen in detail in FIG. 5. Once module 60 has been hoisted and lowered into position on one of the bays 52 so that its base members 72 rest on support beams 68, securing or positioning pins 78 may be inserted into holes in members 72 and 68 provided for the purpose. Modules 60 are provided with a deck "skirting" 12' which is welded into the deck 12 to complete the deck 12. It should be noted that the floating platform 10 is designed with such bays 52 in a manner that does not place reliance on the modules 60 for the structural integrity of the platform. Thus, one or more or all of the modules may be removed or mixed and matched without fear of jeopardizing the structure of the vessel. It is in this manner that the floating platform of the present invention achieves maximum flexibility and utility.

It is evident that two drilling rigs 22, 24 (or a drilling rig and a production facility) on a single floating platform is attendant with numerous advantages not previously available, as well as some difficulties not previously encountered. With respect to the advantages, dual rigs enable the performance of subsea operations such as the drilling and completion of multiple wells at a single offshore site, in half or possibly less time than required to drill and complete the same number of wells with a single drilling rig. Take as another example the frequently difficult, expensive, and time consuming task of installing the drilling template on the sea floor. Previously, each of the operations required to prepare the site, such as driving piles, etc. and installation of the drilling template had to be performed by a single derrick and its draw works or with other large marine crane vessels. With the semi-submersible of the present invention, the dual rigs provide greater flexibility in the performance of such operations. Even for those operations that can not be performed simultaneously, the dual rigs afford an opportunity for improved efficiency. For example, one of the rigs can be making ready, "rigging up", to perform the next of a series of operations while the other is performing the preceding operation. Take, as another example, the lowering and placement of the drilling template illustrated generally in FIG. 1 by numeral 42. Previously, one technique for handling this heavy and difficult to maneuver piece of apparatus involved attaching a marine riser to the template and lowering the template by means of the marine riser and the draw works of a single derrick. Balance of the template at the end of a long riser under current, wave, and wind action was of constant concern. An unbalanced condition would run the risk of over stressing and damaging the riser and/or the template. With dual rigs, the template 42 can be attached to each of two risers 36 and 38 as illustrated in FIG. 1, thereby significantly increasing the control exercised over the template 42 while reducing the loads born by the risers 36, 38. Risk of losing control of the template 42 is accordingly significantly reduced with the simultaneous and coordinated use of a pair of drilling rigs 22, 24 with their dual risers 36, 38.

Figure 7:
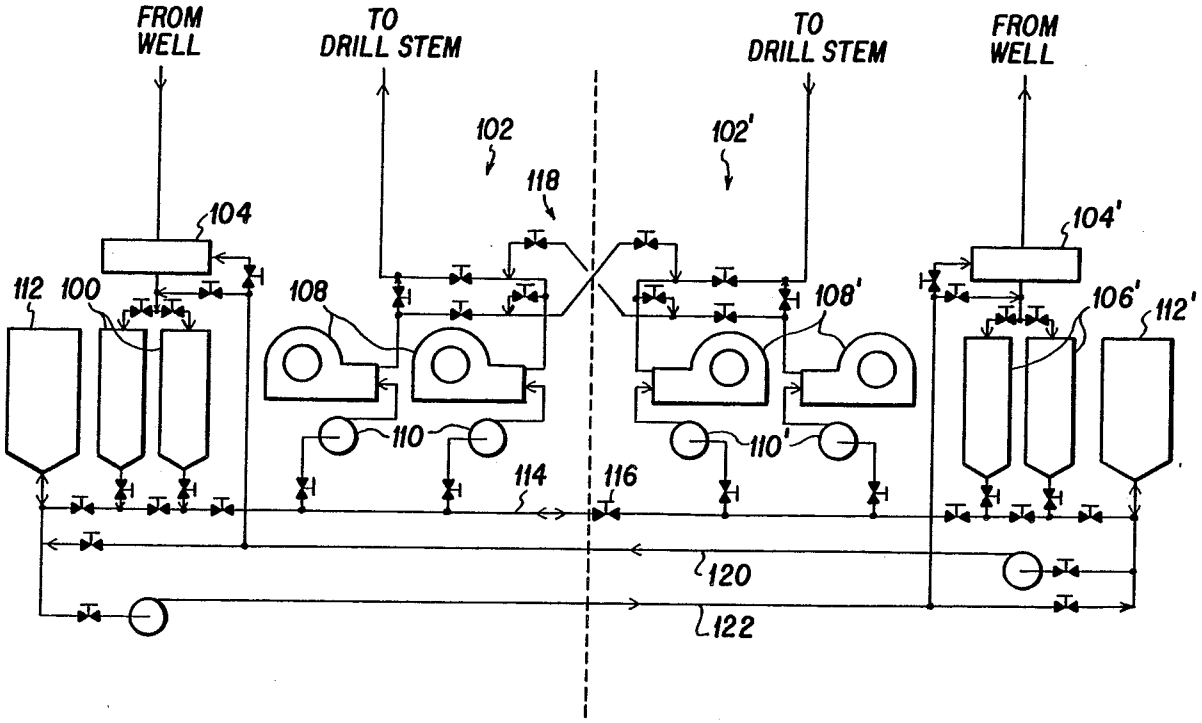
FIG. 7 illustrates a mud pumping and hydraulic system suitable for supporting drilling operations on a semi-submersible having dual drilling derricks.

Referring now to FIG. 7, a portion of the equipment which can be shared by the two drilling derricks of the present invention is described. Specifically, FIG. 7 illustrates a redundant drilling mud system which can bring about significant efficiencies and economies due to the redundancy. There are situations during the drilling of a well which, when encountered, require greater drilling mud and pumping capacity than is normally available for a single drilling derrick. Such situations include recovering from a lost circulation situation, well control to prevent blowout conditions, equipment failure and upper large-diameter hole drilling.

Each of the two systems 102 and 102' comprises mud treatment and solids removal equipment 104, 104', active mud storage tanks 106, 106', two high pressure mud pumps 108, 108' with charging pumps 110, 110' and reserve storage tanks 112, 112'.

Looking now at only one of the two redundant systems, in normal operation mud is pumped from mud tanks 106 through suction manifold 114 by charging pumps 110 to the high pressure mud pumps 108. Pumps 108 deliver the pressurized mud to the drill stem where it circulates down to and through the drill bit, up through the annular region outside of the drill string, and up through the drilling risers while carrying a charge of rock particles or drill cuttings. Such drill cuttings are separated from the drilling mud at the mud treatment equipment 104 before returning to the active mud storage tanks 106. Normally, each of the dual systems operate in stand alone modes independently of one another. Cross hydraulic pumping is provided, however, in anticipation of an event in which operations at one well require additional flow and/or mud volume. Thus, both systems are connected to the same suction manifold 114 which includes an appropriate isolation valve 116. Additionally, a crossover hydraulic system generally illustrated at 118 is provided, downstream of pumps 108, 108' also with suitable valving, as well as two low pressure transfer lines 120, 122 which extend between reserve mud tanks 112 and 112'.

Brief examination of FIG. 7 reveals that when properly configured by opening and closing the appropriate valves, one or both of mud pumps from one side can be connected to provide its output to the other side. In a more conventional operation, the valves on one side may be configured to provide the output of one of the two pumps on one side to assist in the operations of the other side while the remaining pump continues to meet the drilling needs of its respective side.

Figure 3A:
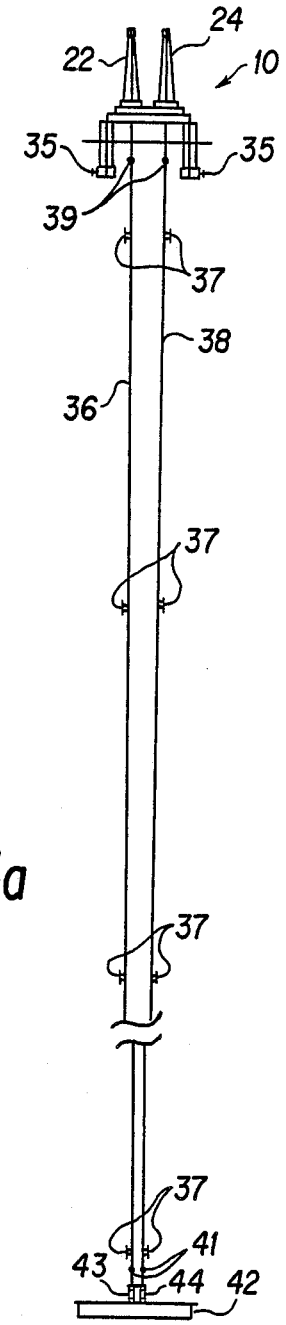
FIG. 3(*a*) is a graphical representation of a semi-submersible vessel of the present invention in operation with dual marine risers each connected to a subsea wellhead by means of a blowout preventer and wellhead connector.
Figure 3B:
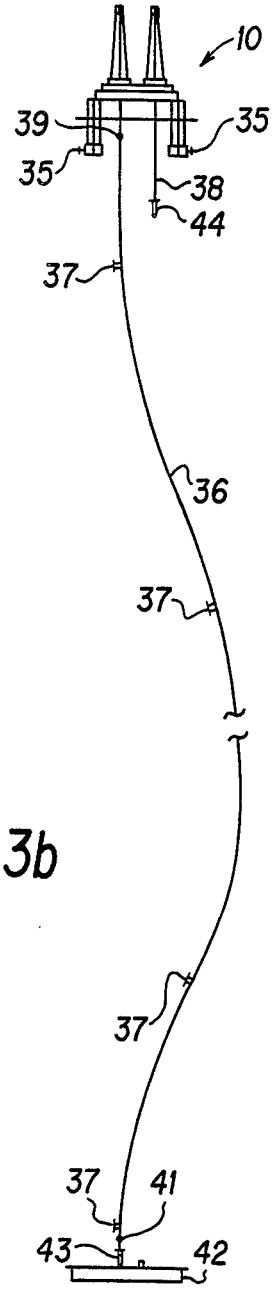

Turning now to FIGS. 3(*a*) and 3(*b*), additional examples of the simultaneous use of two drilling rigs is illustrated. FIG. 3(*a*) shows the floating semi-submersible 10 with its two rigs and a pair of risers 36, 38 while simultaneously performing a pair of drilling operations. Preferably, the separation between the center lines of rigs 22, 24 is approximately 88 feet. On the other hand, a typical distance between wellheads on the template is 20 feet. Thus, it will be appreciated that performing drilling operations simultaneously without interference at two wells in waters from 300′ to 6000′ or greater is, at the same time advantageous, but difficult. While FIG. 3(*a*) shows risers 36, 38 depending from semi-submersible 10 in straight lines, such a situation will rarely if ever exist. The more realistic situation is that the risers 36, 38 will be deflected by sea currents in a manner such as that shown in FIG. 3(*b*). Where both risers are attached to the template, typically by means of similar blowout preventer stacks 43, 44 and have similar properties such as tension, buoyancy, mass, etc., both risers will tend to experience similar deflecting forces and consequently deflect so as to obtain generally parallel, spaced positions. Flexible joints may advantageously be provided at 37, 41 to provide the riser with enhanced flexibility. Typically, however, these flex joints have angular operating limits beyond which the riser operation should not be permitted.

The above described situation, i.e. that of each riser having substantially the same characteristics is the ideal condition and unfortunately is not always attained. As is understood in the oil well drilling art, different conditions encountered at different depths in the borehole being drilled will require different measures to be employed Where each borehole is deviated in order to reach different portions of the reservoir, as is usually the case for offshore platforms, drilling conditions in the two wells are likely to seldom if ever be the same at the same time. Thus, in one example, one riser may contain one drilling fluid while the other may contain a different, heavier fluid. This difference will require management of the two risers in dissimilar manners. The riser with the heavier fluid, for example, would likely require a greater tension to be placed on it in a known manner by its drilling rig in order to prevent buckling and/or collapse. Accordingly, the two drilling risers will rarely have the same properties and will, therefore, not typically maintain parallel configurations under the deflecting influence of currents. Desirably, the locations and angular configurations assumed by the risers may be monitored by the expedient of providing acoustic beacons along the lengths of the risers as illustrated by 37. Such beacons may measure the angular deviation from vertical and azimuth, code this information and transmit the information by sonic signals to the semi-submersible. Hydrophones 35 are provided for receiving the coded data and for determining beacon position by a well known triangularization type of procedure.

Additionally, it is known that the shape assumed by a marine riser is most significantly affected by the motions of the floating semi-submersible which include pitch, yaw, roll, offset, etc. While these factors are important for the management of a conventional single marine riser, they become of greater importance with two risers since with two risers, damage to one or to both can occur by their collision. The present invention addresses these concerns by the employment of a novel dual riser management system which takes all of these considerations into account.

While the tendency is for two risers attached at both ends to deflect in a somewhat similar fashion when exposed to the same exciting forces, such is not the case where one of the risers is attached while the other is unattached as is illustrated in FIG. 3(*b*). In this figure riser 36 is shown in an operational configuration for performing one kind of operation, such as drilling, while the other riser 38 is shown as performing a wholly different kind of operation, i.e. that of lowering and installing a BOP stack 44. Such BOP stacks may run on the order of half a million pounds and be 20 to 50 feet in length, so it is clear that even minor contact between the BOP 44 and riser 36 runs the risk of damaging riser 36. Riser 36 is illustrated in an exaggerated manner as being deflected by currents in the direction of the descending riser 38 and BOP 44. Clearly, since BOP 44 and riser 38 are not yet connected to the sea floor and have not yet passed through the same waters as riser 36, they will be subjected to different deflecting forces. Care must therefore be maintained to monitor the relative positions of risers 36 and 38 and to take into account the different forces exerted and the different properties of the two systems in order to prevent their possible contact.

Figure 6:
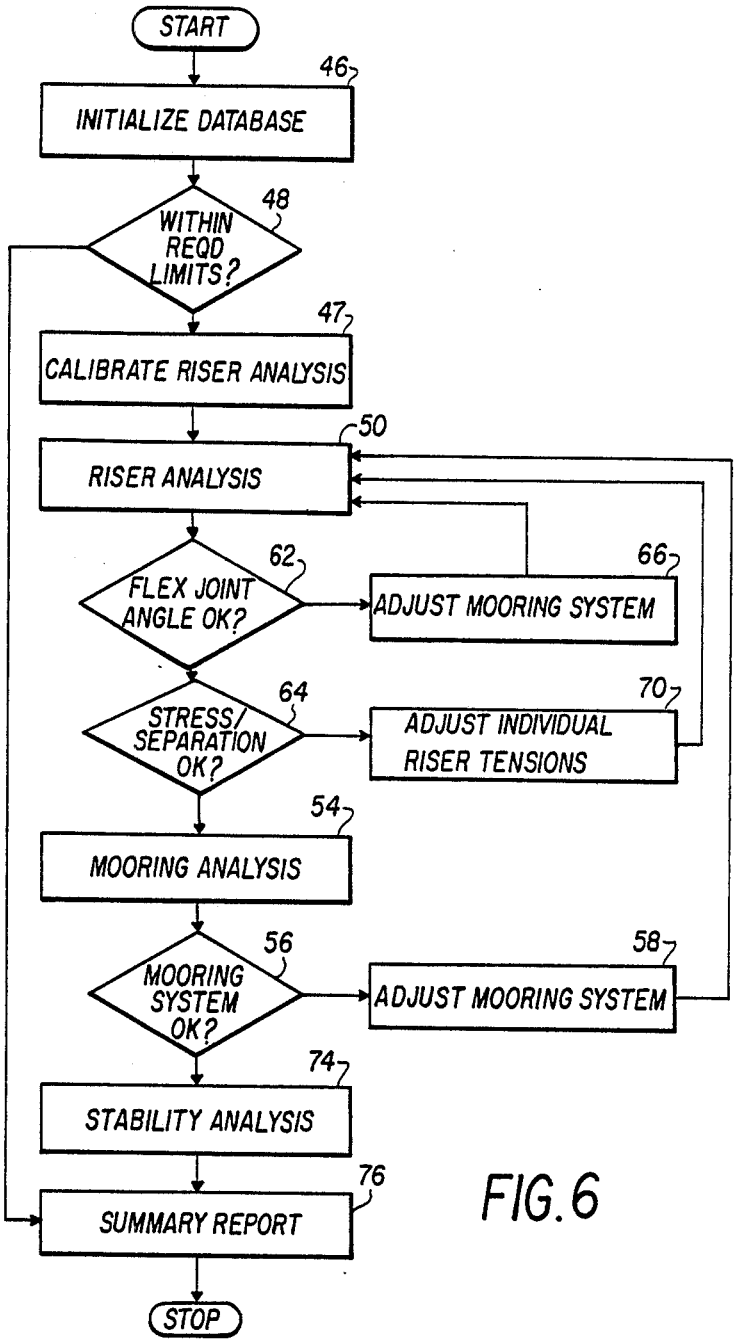
FIG. 6 is a block flow diagram of a dual riser management system.

In this regard, the present invention proposes a novel dual riser management system whose general functions are illustrated in FIG. 6 by means of a quasi block flow diagram. The riser management system comprises data acquisition hardware and three basic software subsystems which are coordinated in the performance of their functions. The three software systems include a riser response analysis system 50, a mooring analysis system 54 and a vessel stability system 74. In its general operation, the dual riser management system first collects appropriate and necessary input data and calculates riser response based on this data. The calculated riser response is then compared to various sensor data which may include but not be limited to sonar data, and other criteria in order to determine if the dual risers are expected to encounter any problems, such as exceeding allowable tensions or approaching the other riser by too close a margin. Following the riser analysis, a mooring analysis is performed based on inputs found necessary for safe riser operation. If the results of the mooring analysis are within limits, the vessel stability subsystem is actuated to analyze whether the previously calculated results are in accord with safe operation of the semi-submersible, and that vessel pitch and roll motions are maintained within a desirable range of values.

A more detailed description of the dual riser management system will now be undertaken with particular reference to FIG. 6. At block 46 the process of initializing data is illustrated. This function basically amounts to establishing and updating a database containing values for all of the parameters required to perform the analyses and comparisons of the overall system including data derived from real time sensors. Certain types of data are fixed such as operating limits and the masses and dimensions of the semi-submersible as well as other parametric values which characterize the hardware of the vessel, the mooring system and the risers themselves. The dual riser management system includes the flexibility for an operator to interactively supply or modify the values of the parameters in order to permit the evaluation of a hypothetical system or set of circumstances. A second type of data is collected and stored on a real time basis such as the values of appropriate environmental conditions like wind speed, current magnitude and direction, wave height and period, as well as real time data such as riser tension, mud weights, mooring line tensions, vessel offset, separation distances between risers, etc. For an illustrative description of the data utilized and the software subsystems themselves reference is made to the following publications which are hereby incorporated by reference for all purposes "Methods of Analysis for Marine Riser Design and Operations" presented at the 37th Petroleum Mechanical Engineering Workshop and Conference, Dallas, Tex. in September of 1981 by R. D. Young; "An Analysis of Marine Risers for Deep Water" presented at the 1973 Offshore Technology Conference, OTC Paper 1771 by Ben G. Burke; "An Improved Linearization Technique for Frequency Domain Riser Analysis" presented at the May 1980 Offshore Technology Conference, OTC Paper 3777 by Lawrence P. Krolikowski and Tom A. Gay; "On-Board System Provides Stability, Mooring, and Motion Analysis for Semi-submersible Drilling Operations," presented at the 1987 SPE-/IADC Drilling Conference SPE/IADC Paper 16067 by R. D. Foreman, P. A. Beynet and S. N. Singhal; and American Petroleum Institute document "RP2P: The Analysis of Spread Mooring Systems for Floating Drilling Rigs."

As mentioned, real time data is accumulated for use in the analyses. Hardware for the accumulation of the types of real time data is generally described in the following references which are also hereby incorporated by reference for all purposes U.S. Pat. No. 4,031,544 to Robert Anthony Lapetina entitled "Sonar/Television System for Use in Underwater Exploration;" and Offshore Technology Paper 4684 entitled "Instrumentation for Monitoring Behavior of Lena Guyed Tower" by W. C. Lamb Jr., H. C. Hibbard, A. L. James, W. A. Koerner and R. H. Rothberg presented at the 1984 Offshore Technology Conference.

Upon completing the task of initializing the data at 46, the system determines at 48 whether riser flex joint angles, stresses, riser-riser separation and mooring line tensions are within their specified normal operating range. If any of these parameters are out of their normal operating ranges, the system proceeds to determine how corrections can be made as described below. If all parameters are within the normal operating range, a notification is made at 76 that all operations are normal and a status report is produced.

Where a parameter has been found to be out of bounds, the evaluation process proceeds at 47 where a system calibration is performed with the real time data. After an initial riser analysis has been made at 50, it is possible, and frequently desirable, to compare the results of the analysis with real time data to verify the accuracy of the model used in the analysis. For example, upper and lower ball joints 39, 41 may have been outfitted with transducers for the purpose of providing ball joint angle measurements. Upon completion of an analysis, the predicted angles for these ball joints may be compared with the measured angles. Where agreement is achieved, confidence in the riser analysis model is reinforced but where disagreement is noted, model modification is in order. Similar comparisons can be made between predicted riser position and actual position as determined from the beacons 37. The results of the riser response analysis of software subsystem 50 are then evaluated at 62 for riser joint angle and subsequently at 64 for riser stress and separation. The system's database holds predetermined values of acceptable and nonacceptable joint angle, stress and approach distances between the two risers. When the riser analysis system 50 produces a flex joint angle, stress or separation distance which is not acceptable, thereby indicating unacceptable operating conditions, the system proposes adjustments in mooring line tension at 66 or riser tension at 70 for one or the other or both of the risers (riser tension is the predominant controllable parameter effecting riser position). Where the system has proposed an acceptable increase or decrease of riser tension for one or both of the risers the system reanalyses the riser response at 50 with the new tension values and the process is repeated. In the event that an acceptable riser tension can not be achieved the system produces an output alerting the operator of that fact and of the fact that operational changes other than riser tension are in order to avoid an unwanted event such as riser/riser contact or riser damage or separation.

Once it has been determined that flex joint angle, riser stress and riser-riser separation are within design limits, software subsystem 54 is prompted to perform a mooring analysis with the new loading parameters to verify that the changes that have occurred or that are proposed have not caused the mooring system to exceed its design limits. If so, 58 suggests mooring line tension adjustments and the process is repeated with a new riser analysis at 50. Finally, where flex joint angle, riser stresses and separations, and mooring line tensions all fall within their design limits, an analysis of the vessel stability is performed at 74 to determine if the new parameters have rendered the semi-submersible unstable, or have imparted unsuitable motion characteristics to the vessel. If the results of this analysis are acceptable, element 76 is prompted to output the new, acceptable operating parameters in the manner of a summary report.

As previously indicated the dual riser management system illustrated in FIG. 6 may respond periodically and automatically to actually changing conditions and alert the operator of situations tending toward the violation of predetermined design limits. Alternatively, the operator can input hypothetical data to thereby plan and confirm the safety of a proposed operation such as the installation or removal of a BOP alongside a BOP and riser already in place. The primary variables available to the operator in either reacting to a potentially dangerous situation or in optimizing a proposed operation are riser tension, riser mass (effected by the contents of the riser such as drill pipe and drilling mud) and semi-submersible vessel positioning or "offset." While these are the primary controllable variables, others might also be utilized such as controlling the flexibility of the flex joints incorporated in the marine riser, and deciding to work at every other wellhead rather than at adjacent wellheads, thereby increasing the separation of the lower ends of the risers. In designing marine risers, the described dual riser management system may be utilized in evaluating additional variables such as riser stiffness/flexibility, riser drag resistance and riser buoyancy. Of course, in real time operations one alternative which is always available is to terminate one or more of the planned operations to wait for more favorable environmental conditions or ultimately, to separate the risers from the wellheads and move the semi-submersible off of the well site to accommodate severe weather conditions.

What is claimed is:

1. A system for conducting hydrocarbon production operations which may include drilling, hydrocarbon fluid handling or subsea manipulation of apparatus useful in drilling or hydrocarbon production, while experiencing more than three of: vertical movement, x horizontal movement, y horizontal movement, yaw, pitch and roll, comprising:

(a) a surface floating work platform for positioning above a well location on the sea floor;

(b) a first work station situated on said floating work platform;

(c) a second work station situated on said floating work platform;

(d) a first longitudinally extending means depending from said first work station and extending toward the floor of the sea for performing first subsea operations;

(e) a second longitudinally extending means depending from said second work station and extending toward the floor of the sea for performing second subsea operations, said first and second longitudinally extending means being subject to sea current deflection;

(f) means for monitoring the relative positions of said first and second longitudinally extending means; and (g) means responsive to said position monitoring means and supported by said floating platform for coordinating simultaneous management of said first and second longitudinally extending means while performing said first and second subsea operations.

2. The system of claim 1 wherein said first and second work stations each include a drilling system and one of said first and second longitudinally extending means includes a marine riser.

3. The system of claim 2 wherein said floating work platform has a structural frame adapted for accommodating the removal of one of said drilling systems and the installation of a fluid handling system.

4. The system of claim 3 wherein said structural frame defines a plurality of bays into which modules of said drilling system or of said hydrocarbon fluid handling system may be selectively inserted.

5. The system of claim 1 wherein one of said first and second work stations includes a drilling system and the other of said work stations includes a hydrocarbon fluid handling system.

6. The system of claim 5 wherein one of said first and second longitudinally extending means includes a marine riser.

7. The system as claimed in claim 1 wherein said system is a semi-submersible floating vessel which includes:

(a) means at one of said work stations for accommodating replacement of one of said systems by another of said systems.

8. The system of claim 7 wherein said means for assisting operations includes first and second fluid circulation systems for said first and second work stations respectively and selectively configurable hydraulic means interconnecting said first and second fluid circulation systems.

9. A system as recited in claim 1 wherein said simultaneous management system comprises;

(a) means for generating signals indicative of parameters descriptive of natural elements capable of changing the position of one of said longitudinally extending elements;

(b) means for generating signals indicative of the status relative to the stress and position of one of said longitudinally extending elements;

(c) means for generating signals indicative of the status relative to the stability and position of said vessel; and (d) means responsive to at least some of said signals of elements (a), (b), and (c) for modeling the stress and position of one of said longitudinally extending elements.

10. The system of claim 9 further including means for generating signals indicative of hypothetical values for the signals of elements (a), (b), and (c).

11. The system of claim 9 wherein said parameters descriptive of natural elements include wind conditions, tidal conditions, sea current conditions.

12. The system of claim 9 wherein said signals indicative of the status of one of said longitudinally extending elements are selected from the group comprising: tension in the element, element density, element flow resistance profile, element stiffness, distance between the element and neighboring obstacles, distance between the bottom of the element and the sea floor.

13. The system of claim 9 wherein said signals indicative of the status of said vessel are selected from the group comprising: vessel position, vessel anchor cable tension, vessel wind flow profile and resistance.

14. The system of claim 9 wherein said modeling means comprises a subsystem for analyzing riser conditions, a subsystem for analyzing semi-submersible mooring conditions, and a subsystem for analyzing semi-submersible stability and motions.

15. The system of claim 1 wherein said means for permitting one of said work stations to assist in the hydrocarbon production operation of the other of said work stations includes first and second fluid circulation systems for said first and second work stations respectively and selectively configurable hydraulic means interconnecting said first and second fluid circulation systems.

16. A system for conducting hydrocarbon production operations, which may include drilling, hydrocarbon fluid handling or subsea manipulation of apparatus useful in marine drilling or hydrocarbon production, while experiencing more than three of: vertical movement, x horizontal movement, y horizontal movement, yaw, pitch and roll, comprising:

(a) a surface floating work platform for positioning above a subsea well location, said floating work platform having dual work stations for performing hydrocarbon production operations;

(b) marine risers subject to sea current deflection depending from each of said dual work stations;

(c) means for monitoring the relative positions of said first and second longitudinally extending means;

(d) position maintaining means connected to said floating work platform for positioning said floating work platform above a location on the sea floor and for permitting said floating work platform more than three degrees of freedom of movement; and (e) means carried by said floating work platform for adjusting said position maintaining means to position said floating work platform in response to said position monitoring means.

17. A method for simultaneously conducting dual hydrocarbon production operations which may include drilling and/or hydrocarbon fluid handling, or subsea manipulation of apparatus useful in drilling or hydrocarbon production, from a surface floating vessel while experiencing more than three of: vertical movement, x horizontal movement, y horizontal movement, yaw, pitch and roll, comprising the steps of:

(a) suspending a first longitudinally extending element from a first work station situated on said floating vessel;

(b) suspending a second longitudinally extending element for conducting a second operation from a second work station situated on said floating vessel, said first and second elements being subject to sea current deflection;

(c) determining parametric values of variables which could influence the stress or position of said first and second longitudinally extending elements;

(d) determining, from calculations using models of said first and second elements, and said parametric values, a predicted stress or position of said first and second longitudinally extending elements; and (e) in response to said predictions, instituting corrective action designed to prevent the interference of one of said elements with the other of said elements.

18. The method of claim 17 wherein said corrective actions are selected form the group comprising the members: moving the floating platform, adjusting the tension in one of said longitudinally extending elements, adjusting the density of one of said longitudinally extending elements, and adjusting the stiffness of one of said longitudinally extending elements

19. The method of claim 17 wherein said hydrocarbon production operation comprises installing a subsea drilling template by supporting each of the opposite sides of said template by a longitudinally extending element marine riser depending from its respective work station.

20. The method of claim 17 wherein said hydrocarbon production operation comprises the movement of a blow out preventer with one of said longitudinally extending elements while the other of said longitudinally extending elements remains in its operative position.

* * * * *